US007880711B1

(12) United States Patent
Werner

(10) Patent No.: US 7,880,711 B1
(45) Date of Patent: Feb. 1, 2011

(54) IMAGE STABILITY IN LIQUID CRYSTAL DISPLAYS

(75) Inventor: Ralph A. Werner, Burnsville, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 945 days.

(21) Appl. No.: 11/796,970

(22) Filed: Apr. 30, 2007

(51) Int. Cl.
*G09G 3/36* (2006.01)

(52) U.S. Cl. ..... 345/98; 345/87; 345/89; 345/97; 345/100; 345/103

(58) Field of Classification Search ..... 345/7, 345/8, 58, 87, 89, 97, 98, 100, 101, 103, 345/13, 158, 174, 204, 530, 531, 547, 692; 348/441; 358/302; 362/373; 349/15
See application file for complete search history.

(56) References Cited

U.S. PATENT DOCUMENTS 4,543,645 A * 9/1985 Vigarie ..... 345/587
4,639,720 A * 1/1987 Rympalski et al. ..... 345/174
4,935,820 A * 6/1990 Patel et al. ..... 358/302
5,068,649 A * 11/1991 Garrett ..... 345/89
5,153,568 A * 10/1992 Shaw ..... 345/88
5,245,328 A * 9/1993 Garrett ..... 345/696
5,422,033 A * 6/1995 Mochizuki et al. ..... 252/299.01
5,477,858 A * 12/1995 Norris et al. ..... 600/441
5,644,336 A * 7/1997 Herbert ..... 345/603
5,670,973 A * 9/1997 Bassetti et al. ..... 345/58
5,920,301 A * 7/1999 Sakamoto et al. ..... 345/96
6,175,401 B1 * 1/2001 Tanaka et al. ..... 349/172
6,646,628 B2 * 11/2003 Shirochi et al. ..... 345/96
6,912,695 B2 * 6/2005 Ernst et al. ..... 715/792
6,933,917 B2 8/2005 Chung et al.
6,982,775 B2 1/2006 Lee et al.
7,079,097 B2 7/2006 Lee
2002/0011984 A1 * 1/2002 Shirochi et al. ..... 345/96
2003/0034936 A1 * 2/2003 Ernst et al. ..... 345/55
2003/0067420 A1 * 4/2003 Ernst et al. ..... 345/1.3
2006/0145978 A1 * 7/2006 Takatori et al. ..... 345/87
2007/0081344 A1 * 4/2007 Cappaert et al. ..... 362/373
2007/0236432 A1 * 10/2007 Benjamin et al. ..... 345/87
2008/0186334 A1 * 8/2008 Seetzen ..... 345/690
2008/0259004 A1 * 10/2008 Miller et al. ..... 345/76

OTHER PUBLICATIONS

What is TFT LCD TV and LCD Monitor Panel?, NETBORED.com, http://www.netbored.com/classroom/what_is_tft_lcd.htm.

* cited by examiner

*Primary Examiner*—Prabodh M Dharia
(74) *Attorney, Agent, or Firm*—Brooks, Cameron & Huebsch, PLLC

(57) ABSTRACT

One method for providing image stability in a liquid crystal display (LCD) device includes providing a first display image to a plurality of pixel elements of the LCD at a first time, where the first display image includes a first pixel in an on state, transitioning the on state of the first pixel to an off state during a refresh cycle of the first display image, and transitioning the off state of the first pixel back to the on state during a next sequential refresh cycle of the first display image.

18 Claims, 6 Drawing Sheets

IMAGE STABILITY IN LIQUID CRYSTAL DISPLAYS

FIELD OF THE DISCLOSURE

The present disclosure generally relates to displaying images on display devices, such as Liquid Crystal Displays (LCDs) devices. And, in particular, the present disclosure relates to the display of images without flicker on LCD devices.

BACKGROUND

Liquid Crystal Display (LCD) devices are used to display images, including symbols, such as text characters and/or pictures. LCD devices have a display screen with a number of image elements (or pixel elements) that are refreshed at a refresh rate generally above 25 Hz, with values being about 60 Hz in many instances. The display images on the LCD devices may be monochromatic or color.

LCD devices can include a backlight element that provides light through an array of liquid crystal elements that form each pixel of the LCD device. The liquid crystal elements provide the color and transmittance of light (i.e., the luminance) at the location of the pixel.

A succession of image frames can be used to display an image on the LCD device. The light of the successive frames displayed on the LCD device is integrated by the human eye. If the number of displayed image frames per second (i.e., the refresh rate) is sufficiently high, images being displayed in a continuous way can create the illusion of motion. One issue with the use of some LCD devices, however, is that of luminance flashes or luminance jumps as the displayed image frame changes. These flashes and/or jumps are also referred to as flicker.

Flashes and/or jumps on LCDs can be due to differences between the rise and fall rates of pixel luminance changes (i.e., the turn ON and turn OFF times of the LCD pixel elements), for example, when large numbers of pixels are simultaneously being changed. For example, flashes on an LCD can occur when a high contrast image is shifted (or scrolled) one pixel up, down, left, and/or right on the screen. The rise and fall rates of LCD pixel luminance changes can also be affected by the initial and final color state (i.e., image content), LCD type, manufacturing process variation, temperature variation, and viewing angle. Human eye sensitivity to the luminance jumps on LCDs may also vary with each individual.

A scrolling image, such as a sonar waterfall, is an example where flashes and/or jumps can occur with each scroll step of the image. When the image is scrolled, a large number of adjacent pixel elements may be changing from light to dark at the same time that a large number of adjacent pixel elements are changing from dark to light. Differing rise and fall rates (i.e., ON/OFF times of the adjacent pixel elements) during these complementary pixel transitions may result in flashes and/or jumps in the LCD display.

SUMMARY

Embodiments of the present disclosure provide various methods, apparatuses, and systems for providing image stability in a liquid crystal display (LCD) device. Embodiments provided herein include controlling pixels of the LCD device so as to provide image stability in the LCD device. As used herein, image stability can include producing stable images in the LCD device that have reduced, or are free of, luminance flashes and/or jumps (i.e., flicker).

In various embodiments, one or more pixel elements of the LCD device that are used to transmit light in forming an image in the LCD device (i.e., in a "light state") can be transitioned between an "on state" and an "off state" for the refresh cycles of a plurality of pixel elements of the LCD device. In one embodiment, transitioning the pixel elements occurs in a cycling process, where the pixel elements providing luminance for an image undergo a sequence of a recurring on state/off state events during each refresh cycle of the LCD. In contrast, the one or more pixel elements of the LCD device that do not transmit light in producing an image are referred to as being in a "dark state."

Transitioning the pixel elements in this cycling manner can produce an area of brightness around adjacent pixel elements that has a repeating visual pattern. The repeating visual pattern of the area of brightness can be perceived by the viewer as having a consistent luminance, even though the image provided by the pixel elements may be changing. The consistent luminance of the repeating visual pattern allows the eye of the viewer to integrate the image, changing or not, into stable images that do not flicker or show luminance jumps, among other benefits.

As used herein, an "off state" for a pixel element includes a situation where the liquid crystals of a pixel reduce or prevent light from being transmitted due to the absence of an applied voltage difference across the liquid crystals. In various embodiments, the "off state" of one or more pixel elements can also include a state in which the one or more pixel elements are actively changed to black and/or a gray, as discussed herein. In other words, a voltage difference can be applied to the one or more pixel elements to change them to black and/or gray. As used herein, an "on state" for a pixel element includes a situation where the liquid crystals of a pixel (e.g., including subpixel elements) allow light to be transmitted due to the presences of an applied voltage difference across the liquid crystals.

By way of structure, LCD devices include thin-film transistors (TFTs) in a TFT panel, a driving-circuit unit, a backlighting system, and an assembly unit (e.g., a housing), among other components. The backlighting system can include those having a variety of backlight types and sources.

Such devices can include backlit and/or sidelit displays. Light sources can include light emitting diodes (LEDs), ultra high pressure (UHP) lamps, and fluorescent lamps such as cold cathode fluorescence lamps or external electrode fluorescent lamps, among other suitable light sources.

The TFT panel can include a TFT-array substrate and a color-filter substrate, in some embodiments. The TFT-array substrate can contain the TFTs, storage capacitors, pixel electrodes, and interconnect wiring. The color-filter substrate can contain a black matrix and resin film containing color pigments or dyes (e.g., red, blue, and green).

Glass substrates can be used to contain the LC material and polarizer films can be attached to the outer surfaces of the glass substrates. A set of boding pads can be provided on each end of gate- and data-signal bus-lines on which to attach LCD Driver integrated circuit chips. Electrical signals sent to bus-lines can cause the liquid crystals in the pixel elements to react by filtering out or projecting light onscreen to form the display image.

In many devices, the screen of the LCD device is completely redrawn with a new image many times a second. The time it takes for the LCD device to redraw, for example, a portion of or the entire screen can be referred to as the refresh cycle of the LCD device. The faster the refresh cycle, the faster the LCD device redraws the frame. Refresh cycles can have values to provide refresh rates for the LCD device of, for example, 60 Hz (i.e., 60 frames displayed every second) and faster (e.g., 85 and 120 Hz).

In various embodiments, the present disclosure provides for first display image information (i.e., data used to produce a first image) to be provided to a plurality of pixel elements of the LCD device at a first time. The LCD device can provide the first display image information to the pixel elements during a refresh cycle of the LCD device.

In the various embodiments, the LCD device transitions the on state of the pixel elements producing the first display image to an off state during a portion of a refresh cycle of the first display image. The LCD device can then transition the pixel elements in the off state back to the on state during a next sequential refresh cycle so as to continue to provide the first display image on the LCD device.

In other words, in some embodiments, a preselected group of the pixel elements used in forming the first display image on the LCD device can be transitioned, or cycled, between a first state (e.g., the on state) and a second state (e.g., the off state) during each refresh cycle of the first display image on the LCD device. So, for example, transitioning, or cycling, a first pixel of the one or more pixel elements from an on state to an off state, or from an off state to an on state, can occur in each of a single refresh cycle of the LCD device. As will be appreciated, the transition time of the pixel elements for the LCD display can be fast enough to turn on and off in one refresh cycle.

For the various embodiments, the transitioning of one or more of the pixel elements during the refresh cycle can occur during different parts and/or portions of the refresh cycle. So, transitioning a first pixel of the one or more pixel elements to the off state during the refresh cycle of the first display image can occur during one of a first part or a second part of the refresh cycle.

As appreciated, the "parts" or "portions" of the refresh cycle do not necessarily have to be equal. For example, the timing of the transition from the on state to the off state, or from the off state to the on state, can be dependent upon the response time of the one or more pixels to rise to the on state (i.e., the pixel turn on time) and to fall from the off state (i.e., the pixel turn off time), which ever is longer. As such, the exact timing of the transition from the on state to the off state, or from the off state to the on state, may be dependent upon a variety of known factors, including the type, configuration, and structure of the LCD device.

For the various embodiments, transitioning a preselected group of pixel elements, which can include the first pixel, during each refresh cycle can occur about half way through the refresh cycle. The transitioning of the pixel elements between the off state and the on state can continue for one or more of the refresh cycles, including for each of the refresh cycles.

For example, the first pixel can be in an on state for a first portion (e.g., a first half) of the refresh cycle and then transitioned to the off state for a second portion (e.g., a second half) of the refresh cycle. In an alternative embodiment, the first pixel can be in an off state for the first portion of the refresh cycle and then transitioned to the on state for the second portion of the refresh cycle. In such latter embodiments, the pixel can be sampled at the beginning of the refresh cycle, but not displayed until the last part of the refresh cycle so as to minimize the signal propagation time.

In some embodiments, the first and second portions, or parts, can each be fifty percent (50%). As will be appreciated, other values approximate to fifty percent (50%) could also be used for the first and second portions.

In some embodiments, the first portion of the refresh cycle can include a number of different percentages of the duration of the refresh cycle (i.e., not necessarily fifty percent (50%)). For example, the first portion of the refresh cycle can have a value of twenty five percent (25%) to fifty percent (50%) of the duration of the refresh cycle.

Alternatively, the first portion of the refresh cycle can have a value of ten percent (10%) to fifty percent (50%) of the duration of the refresh cycle. Other ranges include, but are not limited to, 5% to 40%, 5% to 50%, 10% to 40%, 20% to 40%, 20% to 50%, and 25% to 40%, among others.

Regardless of the percent of duration, for various embodiments transitioning the pixel elements can be synchronized with a start of the refresh cycle. So, for example, the pixel elements can be synchronized to be in the off state at the start, or beginning, of each of the refresh cycles. Alternatively, the pixel elements can be synchronized to be in the on state at the start, or beginning, of each of the refresh cycles.

In various embodiments, the on state and/or the off state of the pixels can also be synchronized with a change of the first display image to a second display image. For example, first display image information can be provided to the plurality of pixel elements (e.g., a first group of pixel elements) with the pixel elements in the off state during the beginning of a first refresh cycle. The first display image can be updated in subsequent refresh cycles, where the updating to the pixel elements occurs with the pixel elements in the off state during the first portion of the refresh cycle.

Then, for example, when the second display image information is provided to the plurality of pixel elements (e.g., a second group of pixel elements) at a second time to replace the first display image information, it can be done with the pixel elements in the off state during a refresh cycle. Once replaced, the pixel elements can be turned, or set, to the on state to display the second display image. The transitioning of the pixel elements between the off state and the on state can continue for the refresh cycles for the display of one or more images on the LCD device.

In the various embodiments, the LCD device transitions the on state of the pixel elements producing the second display image to an off state during a portion of a refresh cycle of the second display image. The LCD device can then transition the state of the pixel elements in the off state back to the on state during a next sequential refresh cycle so as to continue to provide the second display image on the LCD device.

In other words, in some embodiments, a preselected group of the pixel elements used in forming the second display image on the LCD device can be transitioned, or cycled, between a first state (e.g., an on state) and a second state (e.g., an off state) during each refresh cycle of the second display image on the LCD device. So, for example, transitioning, or cycling, a second pixel of the one or more pixel elements from one of an on state to an off state or from an off state to an on state can occur in each of a single refresh cycle of the LCD device.

Making reference again to the example of the first and second pixel elements, the second display image can use the second pixel to transmit light and the first pixel remains off (not transmit light) in providing the second image. So, for example, the second pixel can transition between the on state and the off state for the refresh cycles, as discussed herein, while the first pixel now remains in the off state to provide the second display image on the LCD device.

In displaying this second image, however, a situation can arise in which adjacent pixel elements of the pixel matrix (e.g., the first pixel and the second pixel) may change from either transmitting light (e.g., the "light state") or not transmitting light (e.g., the "dark state") to not transmitting light or transmitting light, respectively. This transition of adjacent pixel elements, or group of pixel elements, can create luminance flashes or luminance jumps (i.e., flicker) as the displayed image frame changes. This is possible, for example, when the adjacent pixel elements in a high contrast situation undergo a change from light to dark at the same time other groups of adjacent pixels are changing from dark to light.

This can be due to differences between the rise and fall rates of pixel luminance changes (i.e., the response time of the pixel elements to turn on and to turn off). For example, flashes on an LCD device can occur when a high contrast image is shifted (or scrolled) one pixel up, down, left, and/or right on the screen. The rise and fall rates of LCD pixel luminance changes can be affected by the initial and final color state (i.e., image content), LCD type, manufacturing process variation, temperature variation, and viewing angle, as discussed herein. Human eye sensitivity to the luminance jumps on LCDs may also vary with each individual.

A scrolling image, such as a sonar waterfall, is an example where flashes and/or jumps can occur with each scroll step of the image. When the image is scrolled, a large number of adjacent pixel elements may be changing from light to dark at the same time that a large number of adjacent pixel elements are changing from dark to light. Differing rise and fall rates (i.e., ON/OFF times of the adjacent pixel elements) during these complementary pixel transitions may result in flashes and/or jumps in the LCD display.

In various embodiments of the disclosure, image stability can be provided for the displayed images by having the pixels that are changing from a dark state to a light state or visa versa (e.g., when the image is scrolling) synchronize their transition so that the pixel elements that are changing are in the same state (e.g., both dark or in the off state) just prior to the change from the dark state to the light state or visa versa. For the various embodiments, this produces a repeating sequence of visual pulses, also referred to as an "area of brightness", having a similar average luminance per refresh cycle for adjacent pixel elements of the first display image and the second display image.

The area of brightness around adjacent pixel elements providing the repeating visual pattern is perceived by the viewer as having a consistent luminance. The consistent luminance of the repeating visual pattern allows the eye of the viewer to integrate the image, changing or not, into stable images that do not flicker or show luminance jumps, among other benefits.

In some embodiments, this consistent repeating pattern of luminance produced in the area of brightness can have a repetitive wave shape that is similar for both the first image and the second image. In various embodiments, the consistent repeating pattern of luminance can have a consistent luminance, and even have a constant luminance.

For example, adjacent pixel elements can produce repeating visual pulses per refresh cycle that can have a similar average luminance. So, the observer will see the repeating sequence of pulses when the image is stable and when the image is moving and the average luminance per refresh cycle does not change and so no flicker is observed.

In additional embodiments, cycling a pixel between an on state and an off state for a refresh cycle can also include inserting one of a black frame and/or a gray frame for the off state of the pixel element. So, for example, transitioning the on state of the first pixel and/or the second pixel to an off state can include inserting a black frame for the off state of the first pixel and/or the second pixel. Alternatively, transitioning the on state of the first pixel and/or the second pixel to an off state can include inserting a gray frame for the off state of the first pixel and/or the second pixel.

In various embodiments, a level of the gray frame used in the present disclosure can include an average luminance corresponding to an average luminance of the LCD device. In an additional embodiment, the level of the gray frame used can be an average luminance of two or more adjacent pixel elements (e.g., the first pixel and the second pixel).

In some embodiments, the gray frame can be inserted between actual frames of the image, regardless of the state of the pixel elements, to provide a stable image in an LCD device. In other words, a gray frame can be inserted between the frames providing the image on the LCD device.

For example, a first display image can be provided to the pixel elements of the LCD device at a first time. A preselected group of the pixel elements used in providing the first image can be transitioned, or cycled, between a first state and a second state during each of the refresh cycles of the first display image.

Examples of a preselected group of pixel elements can include a random selection of at least fifty (50) percent of the pixel elements of the LCD. Another example of a preselected group of pixel elements can include at least one of alternate rows and columns of the pixel elements of the LCD. Other combinations of the pixel elements that can be used to reduce or prevent flicker can also be utilized in various embodiments.

In some embodiments, the first state can be the on state, as discussed herein, and the second state can be a gray frame. So, for example, a first pixel of the preselected group of pixel elements providing the first image can cycle between an on state and a gray frame, while an adjacent pixel (e.g., the second pixel) of the first image can be cycle between an off state and the gray frame.

In some embodiments, the gray state used for both groups of pixel elements (e.g., the ones cycling between the on state and the gray state and the ones cycling between the off state and the gray state) can be the same. The gray state used for each group of pixel elements can be different levels of gray. In various embodiments, the average luminance of the LCD screen can be used as the value for the gray level used with some embodiments.

So, for example, when second display image information is provided to the plurality of pixel elements (e.g., a second group of pixel elements) at a second time to replace the first display image information, it can be done while transitioning, or cycling, a preselected group of pixel elements between the first state and the second state during each refresh cycle of the second display image.

As with the first image, the first state can be the on state and the second state can be the gray frame. So, for example, a second pixel of the preselected group of pixel elements providing the second image can cycle between the on state and the gray frame, as discussed, as an adjacent pixel (e.g., the first pixel by way of example) is cycled between the off state and the gray frame.

In various embodiments, the gray frames can be inserted in every other refresh cycle for both the first image and the second image. So, for example, the gray frame can be inserted in odd numbered refresh cycles, while the frames providing the images (e.g., the first image and the second image) are inserted in even numbered refresh cycles. Other suitable patterns for inserting gray frames can be utilized in embodiments of the present disclosure.

Inserting the gray frames as discussed should keep the overall luminance of the images displayed on the LCD consistent for the observer. In addition, through use of such embodiments the observer will view a repeating pattern, as discussed herein, of the consistent luminance, and hence the absence of luminance flashes or jumps.

The functionality discussed above can be accomplished, for example, by logic circuitry and/or by having a processor and memory within or associated with the LCD device. For example, embodiments of the present disclosure can include a display control device for use in the LCD display. The display control device can be used to output, or drive, data for providing images on the LCD display.

In some embodiments, the display control device communicates via a bus, such as a system bus, with an external device, such as a processor and/or memory.

For example, a processor can send pixel data representing an image to be displayed to a memory, such as a display buffer. The display control device can then access the display buffer to display the desired image on the LCD.

As used herein, "external" to the display controller device is meant to be outside of the display controller device, but not necessarily a separate chip or device. For example, if the display controller device is formed as one element of a System on a Chip (SoC), then the external memory or processor can be located on the same chip but comprises a separate circuit element.

In such embodiments, the system bus can be, for example, used to pass signals such as data, addressing, and control signals between various circuits or devices. The bus may have a width in accordance with the requirements of the system, such as 16, 32, 64, or 128 bits, among others.

The display control device can include a main controller, such as logic circuitry, or a processor, that is in communication with the LCD panel. The display controller can also be provided with a refresh cycle clock in communication with the main controller to provide a timing signal for the refresh cycle of the LCD panel.

A data register in communication with the main controller and the refresh cycle clock can receive input pixel values from the processor through the main controller, in some embodiments. A multiplexer in communication with the data register and the refresh cycle clock can route an on state and/or an off state for the pixel value, as discussed herein, to the LCD panel during the refresh cycle.

For example, the data register can sample the pixel value during a first half of the refresh cycle as the multiplexer routes the off state for the pixel value to the LCD panel. The multiplexer can route the on state for the pixel value during the second half of the refresh cycle, as discussed herein.

In some embodiments, the multiplexer can route the on state for the pixel value during a first half of the refresh cycle and route the off state during a second half of the refresh cycle. The main controller can also be used to route the black value and/or the gray value, or frames, through the multiplexer for the off state of the pixel value, as discussed herein. Executable instructions can be provided in the memory and executable by the processor to accomplish the functions described herein instead of or in addition to logic circuitry.

Embodiments of the present disclosure can also provide several advantages over previous approaches to dealing with luminance flashes and jumps. For example, in some embodiments of the present disclosure calibration, or recalibration, of response times for the on and off states of the pixels may not be needed.

This can be an advantage because response times for the on and off states are dependent on a number of factors that can change with the use of the LCD device. These include, but are not limited to, changes in the operating temperature of the LCD device and the configuration of each manufacturer's LCD device. In addition, embodiments of the present disclosure for dealing with luminance flashes and jumps may not be dependent upon a particular viewing angle of the LCD device, which can be an advantage over previous approaches to address luminance flashes and jumps.

These and other advantages of the various embodiments of the present disclosure will become evident to those skilled in the art upon reading the disclosure.

DETAILED DESCRIPTION

Figure 1A:
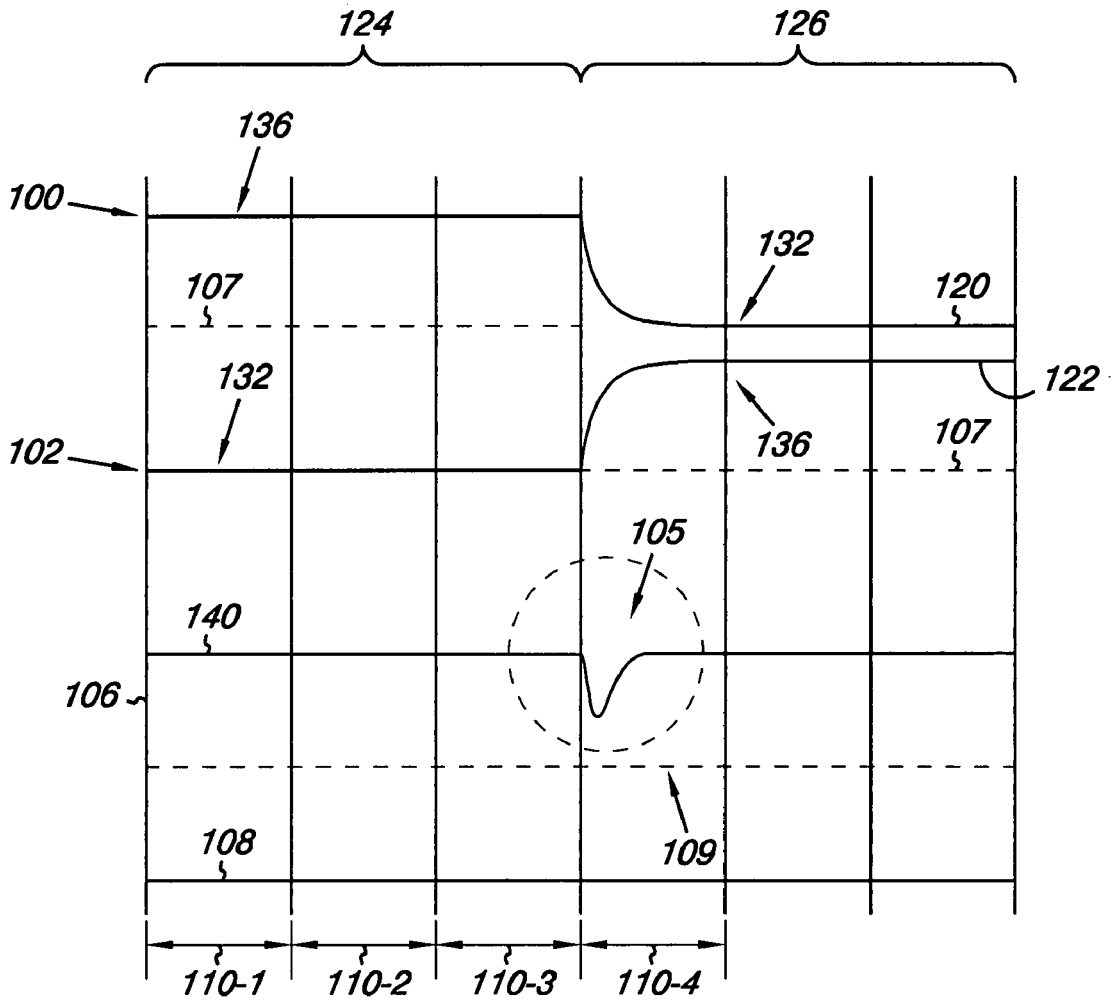
FIG. 1A is an illustration of a luminance flash or jump produced in an LCD device.

The present disclosure includes a number of method, apparatus, and system embodiments for providing image stability in a liquid crystal display (LCD) device. Embodiments of the present disclosure will now be described in relation to the accompanying drawings, which will at least assist in illustrating various features of the various embodiments.

The figures herein follow a numbering convention in which the first digit or digits correspond to the drawing figure number and the remaining digits identify an element or component in the drawing. Similar elements or components between different figures may be identified by the use of similar digits.

Figure 1B:
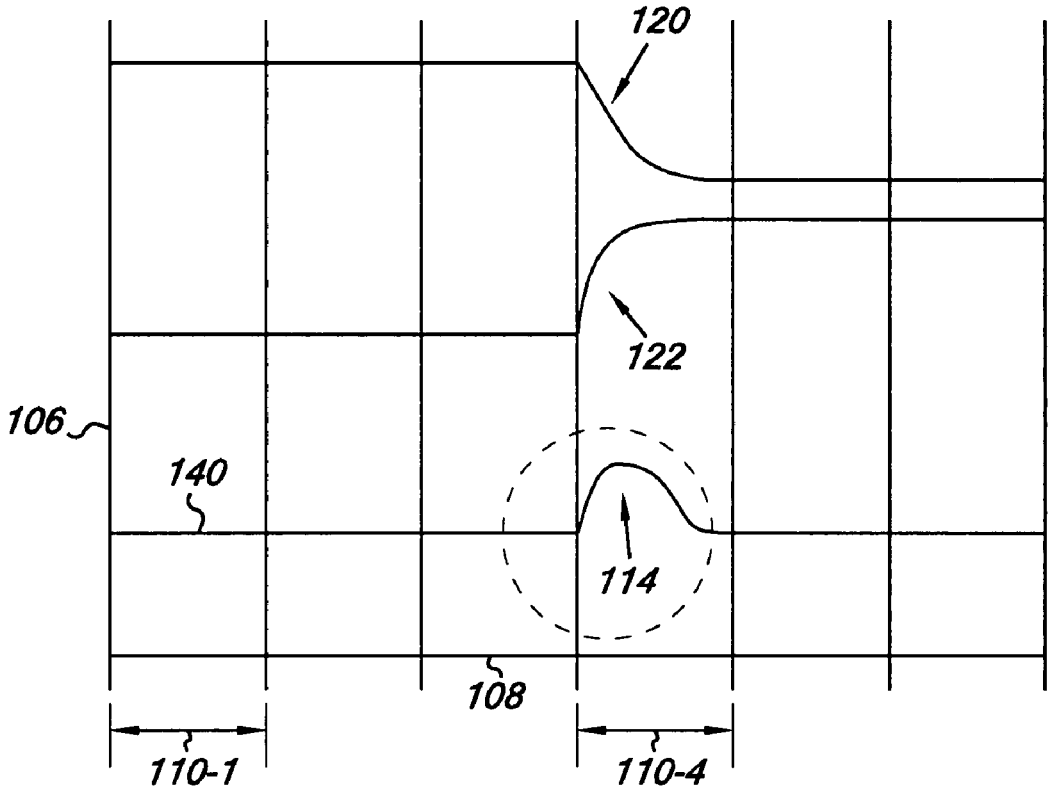
FIG. 1B is an illustration of another type of luminance flash or jump produced in an LCD device.
Figure 2:
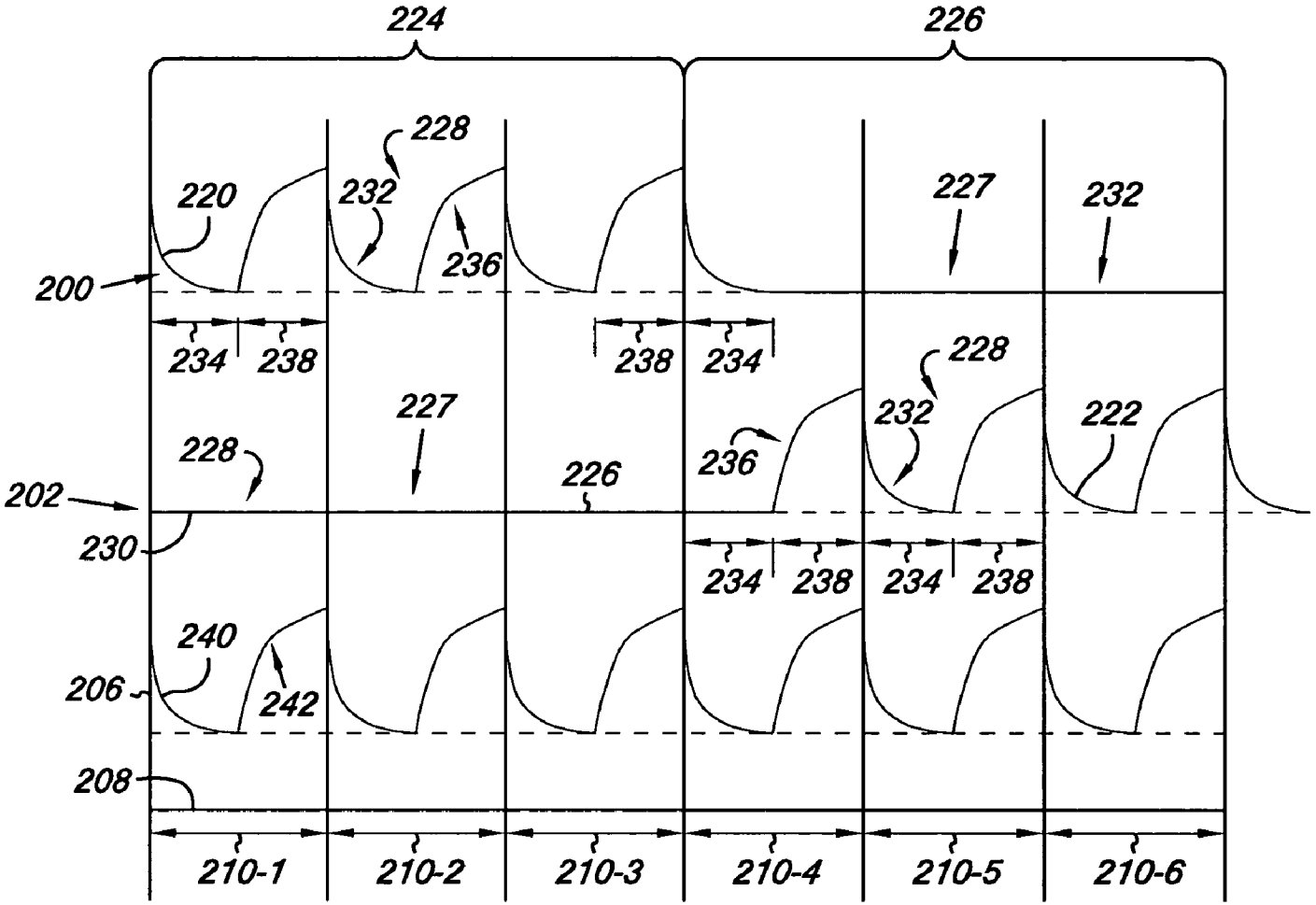
FIG. 2 is an illustration of pixels cycling between off states and on states for each refresh cycle to produce an area of brightness having consistent luminance.

For example, 110 may reference element "10" in FIG. 1, and a similar element may be referenced as 210 in FIG. 2. As will be appreciated, elements shown in the various embodiments herein can be added, exchanged, and/or eliminated so as to provide a number of additional embodiments. In addition, discussion of features and/or attributes for an element with respect to one Figure can also apply to the element shown in one or more additional Figures.

FIG. 1A is an illustration of a luminance flash or jump produced in an LCD device. As illustrated, there is shown a first pixel 100 whose luminance is represented by a line 120, a second pixel 102 whose luminance is represented by a line 122, and the total luminance of the two pixels 100 and 102 represented by the line 140 with luminance on the vertical axis 106 and time on the horizontal axis 108. The dashed line 107 represents a zero luminance level for each of the pixels.

The pixel transitions occur periodically at the refresh time corresponding to a number of refresh rates 110 (two refresh cycles are indicated with a first cycle being labeled 110-1, a second cycle being labeled 110-2, a third cycle being labeled 110-3, and a fourth refresh cycle being labeled 110-4), or refresh cycle, of the display, for example 60 Hz or 16.6 ms. As illustrated, the first pixel is transitioning from an on state 136 in a first image during time 124 to an off state 132 during a second image during time 126. The second pixel is transitioning from an off state 132 in the first image during time 124 to an on state 136 in a second image during time 126.

The total luminance 140 shows a dark flash 105 resulting from a luminance dip caused by the rate of the pixel falling luminance 120 being faster than the rate of the pixel rising luminance 122 on refresh cycle 110-4.

FIG. 1B is an illustration of another type of luminance flash or jump produced in an LCD device. Similar to the illustration of FIG. 1A, FIG. 1B includes a first pixel 100 whose luminance is represented by a line 120, a second pixel 102 whose luminance is represented by a line 122, and the total luminance of the two pixels 100 and 102 represented by the line 140.

In FIG. 1B, luminance is provided on the vertical axis 106, time is provided on the horizontal axis 108, and the refresh rate is provided as 110 (i.e., each of the cycles, such as cycles 110-1 and 110-4 having the same refresh rate). As illustrated, a luminance white flash 114 is created during refresh cycle 110-4 when the total luminance 140 exceeds the average luminance and lasting until the pixel falling luminance 120 and the pixel rising luminance 122 reach their final state. In this case, the pixel rising luminance 122 is faster than the pixel falling luminance 120 resulting in a total luminance 140 that exceeds the average luminance during the pixel transitions.

In practice, the luminance 105 and 114 are only discernible, for example, to a viewer if large numbers of pixel elements perform similar pixel transitions simultaneously. When large numbers of pixel elements perform these transitions simultaneously, the actual luminance flash is the sum of individual pixel luminance flashes.

For example, in some applications, information can be added to the viewable image from the top of the LCD screen being viewed. For instance, in navigation, as an individual moves forward, the new information about the area being encountered can be added to the top of the screen.

In such instances, this added information moves all of the preceding rows of pixel images down the screen to the next row of physical pixels such that the information at the bottom of the screen is being scrolled off the bottom of the screen. This type of application can appear as a waterfall or cascade of information moving down the screen.

An observer expects the luminance of such an image to be consistent from refresh cycle to refresh cycle because most of the average luminance is changing very slowly (e.g., only one row of pixels is added and one row of pixels are removed each time the image is updated and the image may not be updated on every refresh cycle). However in such applications, when the actual rise and fall times are different, this cascading, when refreshed, can cause flashing that can be very distracting and annoying. The luminance variation or flashing can vary depending upon the initial and final state of the pixel transitions.

FIG. 2 provides an illustration of two adjacent pixels elements producing an area of brightness having consistent luminance for display images produced by the LCD device. In the example shown in FIG. 2, graphs of two pixels (as viewed by a viewer) are presented along with a combined graph showing the area of brightness with the transition of information (e.g., the change from a first image to a second image of the displayed images) between the first pixel and the second pixel as viewed by a viewer.

In the top graph, representing a first pixel 200, a pixel state (e.g., light state 228 or dark state 227) is illustrated by a line 220 spanning from the left side to the right side of the top graph. As illustrated, the state of the first pixel 200 changes from a light state 228 in which the first pixel 200 transitions to an off state 232 during the first portion 234 of a refresh cycle 210 (e.g., for each of the refresh cycles 210-1, 210-2, and 210-3) and to an on state 236 during the second portion 238 of a refresh cycle 210 (e.g., for a first image during time 224 on the LCD display) to a dark state 227 in which the pixel remains in the off state 232 for both portions 234 and 238 of each refresh cycle for each of the refresh cycles 210-4, 210-5, and 210-6 (e.g., for a second image during time 226 on the LCD display). As discussed herein, a black and/or gray frame could be inserted for the off state 232 during the first part 234 of each refresh cycle 210 (as shown in the embodiment illustrated in FIG. 4).

In the middle graph, representing the second pixel 202, the pixel state is represented by a line 222 spanning from the left side to the right side of the middle graph. As illustrated, the state of the second pixel 202 changes from a dark state 227 in which the second pixel 202 is in an off state 232 for each portion 234 and 238 of the refresh cycles 210-1, 210-2, and 210-3 (e.g., for the first image 224 on the LCD display) to a light state 228 in which the second pixel 202 transitions to an off state 232 for the first portion 234 of the refresh cycle and to an on state 236 for the second portion 238 of the refresh cycle for each of the refresh cycles 210-4, 210-5, and 210-6 (e.g., for the second image 226 on the LCD display). As discussed herein, a black and/or gray frame could be inserted for the off state 232 during the first part of each refresh cycle 210 (as shown in the embodiment illustrated in FIG. 4).

As illustrated, the transition of the pixel elements 200 and 202 from the first image 224 to the second image 226 can be synchronized to occur when both pixel elements 200 and 202 are in or transitioning to the off state 232. For the embodiment of FIG. 2, this occurs generally, but not necessarily, at the beginning of refresh cycle 210-4. For the various embodiments, this approach can minimize the occurrence of luminance flashes and/or jumps in an LCD device as the display image changes (e.g., from the first image 224 to the second image 226).

As illustrated in the bottom graph, line 240 provides the luminescent combination, or summation, of luminescence for pixels 200 and 202 for the first image 224 and the second image 226. In other words, line 240 provides the combined luminance of the pixels 200 and 202 as viewed by a viewer for the first image during time 224 and the subsequent second image during time 226 on the LCD display.

As is illustrated by line 240, the viewer sees a consistent repeating luminance pattern 242 at each refresh cycle 210-1, 210-2, 210-3, 210-4, 210-5, and 210-6, rather than the discontinuities of lines 220 and 222. In particular there are no discontinuities in the pattern 242 at the transition from the first image 224 to the second image 226 at the beginning of refresh cycle 210-4.

In some embodiments, the first image and second image can have luminance values between an off state and a full on state (e.g., a gray state). In such embodiments, the pixels may change between any of an off state, a full on state, a first middle state (i.e., having a value between off and full on), or a second middle state (i.e., having a different middle value than the first middle state). In the embodiment of FIG. 2, these luminance levels would affect the luminance level during the second part 238 of the refresh cycles 210.

In addition, an area of brightness provided by adjacent pixel elements (e.g., the luminance response or sum of the luminance of the first pixel 200 and the second pixel 202) can provide essentially the same repeating pattern of consistent luminance for the second image as was seen by the viewer for the first image. The viewer's eye can integrate these repeating luminance pulses of the repeating pattern to provide the stable image on the LCD display.

So, when adjacent pixels transition from providing to not providing luminance (or providing more luminance to less luminance in cases of gray states and the like), the overall repeating pattern of the luminance pulses does not change enough for the viewer to see a luminance flash or jump. Because, in many embodiments, the pixel turn on and turn off times are a function of the viewing angle of the observer, one benefit of such a consistent average luminance approach is that the viewer can view the screen from any suitable angle with the benefit of improved flashing characteristics.

In some embodiments, a gray frame could be inserted for the off state 232 during the first half 234 of each refresh cycle 210. This is further illustrated in the embodiment of FIG. 4.

Figure 3:
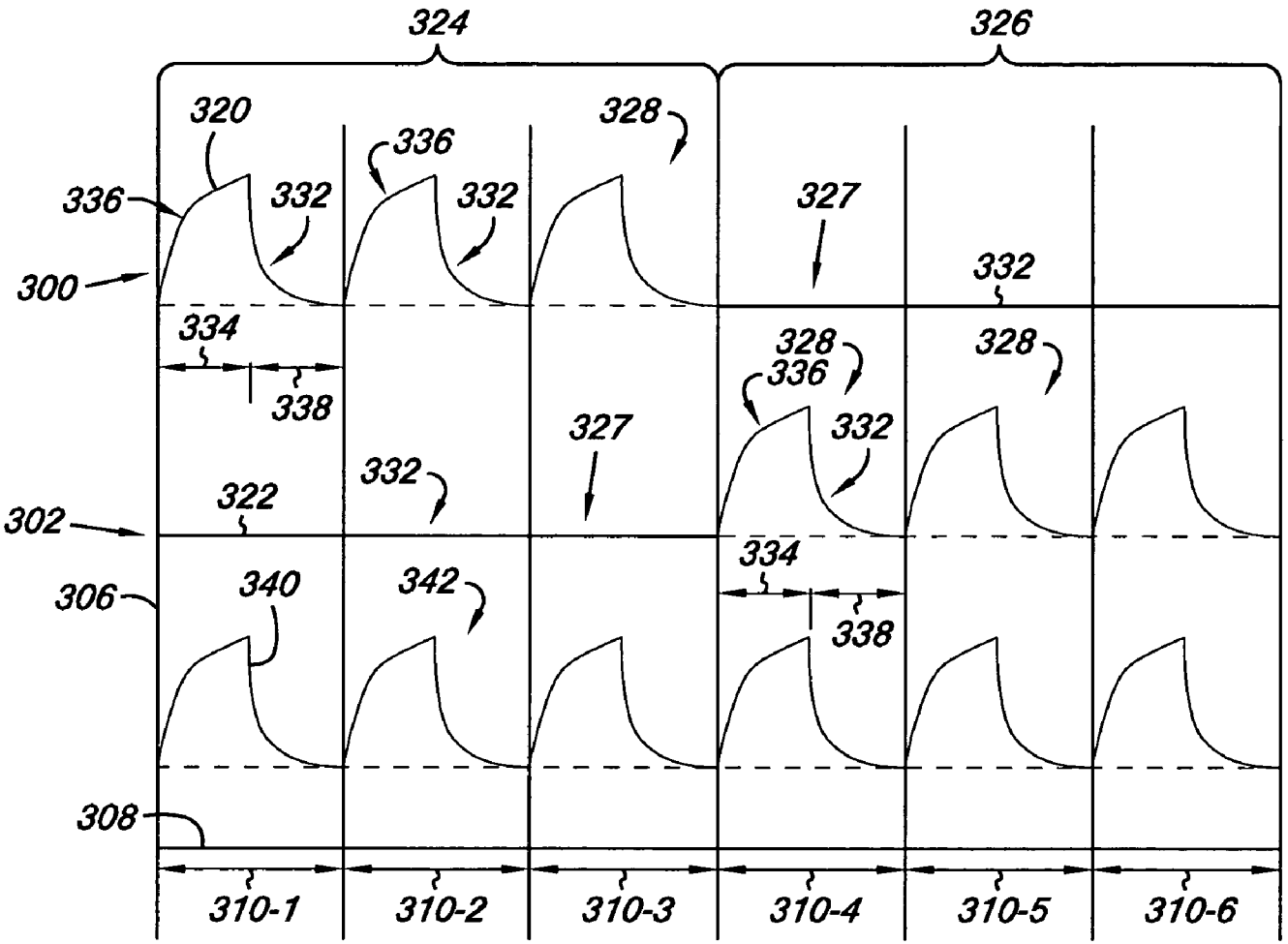
FIG. 3 is an illustration of pixels cycling between on states and off states for each refresh cycle to produce an area of brightness having consistent luminance.

FIG. 3 provides an additional illustration of two adjacent pixels elements producing an area of brightness having consistent luminance for display images produced by the LCD device. In the example shown in FIG. 3, graphs of two pixels (as viewed by a viewer) are presented along with a combined graph showing the area of brightness with the transition of information (e.g., the change from a first image to a second image of the displayed images) between the first pixel and the second pixel as viewed by a viewer.

In the top graph, representing a first pixel 300, a pixel state (e.g., light state 328 or dark state 327) is illustrated by a line 320 spanning from the left side to the right side of the top graph. As illustrated, the state of the first pixel 300 changes from a light state 328 in which the first pixel 300 transitions to an on state 336 during the first portion of a refresh cycle 310 (e.g., for each of the refresh cycles 310-1, 310-2, and 310-3) and to an off state 332 during the second portion of a refresh cycle 310 (e.g., for a first image during time 324 on the LCD display) to a dark state 327 in which the pixel remains in the off state 332 for both portions 334 and 338 of each refresh cycle for each of the refresh cycles 310-4, 310-5, and 310-6 (e.g., for a second image during time 326 on the LCD display). As discussed herein, a black and/or gray frame could be inserted for the off state 332 during the second part of each refresh cycle 310.

In the middle graph, representing the second pixel 302, the pixel state is represented by a line 322 spanning from the left side to the right side of the middle graph. As illustrated, the state of the second pixel 302 changes from a dark state 327 in which the second pixel 302 is in an off state 332 for each portion 334 and 338 of the refresh cycles 310-1, 310-2, and 310-3 (e.g., for the first image 324 on the LCD display) to a light state 328 in which the second pixel 302 transitions to an on state 336 for the first portion 334 of the refresh cycle and to an off state 332 for the second portion 338 of the refresh cycle for each of the refresh cycles 310-4, 310-5, and 310-6 (e.g., for the second image 326 on the LCD display). As discussed herein, a black and/or gray frame could be inserted for the off state 332 during the second part of each refresh cycle 310.

As illustrated, the transition of the pixel elements 300 and 302 from the first image 324 to the second image 326 can be synchronized to occur when both pixel elements 300 and 302 are in or transitioning to the off state 332. For the embodiment of FIG. 3, this occurs generally, but not necessarily, in the middle of or last half of refresh cycle 310-3. For the various embodiments, this approach can minimize the occurrence of luminance flashes and/or jumps in an LCD device as the display image changes (e.g., from the first image 324 to the second image 326).

As illustrated in the bottom graph, line 340 provides the luminescent combination, or summation, of luminescence for pixels 300 and 302 for the first image 324 and the second image 326. In other words, line 340 provides the combined luminance of the pixels 300 and 302 as viewed by a viewer for the first image during time 324 and the subsequent second image during time 326 on the LCD display.

As is illustrated by line 340, the viewer sees a consistent repeating luminance pattern 342 at each refresh cycle 310-1, 310-2, 310-3, 310-4, 310-5, and 310-6, rather than the discontinuities of lines 320 and 322. In particular there are no discontinuities in the pattern 342 at the transition from the first image 324 to the second image 326 at the beginning of refresh cycle 310-4.

In some embodiments, the first image and second image can have luminance values between an off state and a full on state (e.g., a gray state). In such embodiments, the pixels may change between any of an off state, a full on state, a first middle state (i.e., having a value between off and full on), or a second middle state (i.e., having a different middle value than the first middle state). In the embodiment of FIG. 3, these luminance levels would affect the luminance level during the first part 334 of the refresh cycles 310.

In addition, an area of brightness provided by adjacent pixel elements (e.g., the luminance response or sum of the luminance of the first pixel 300 and the second pixel 302) can provide essentially the same repeating pattern of consistent luminance for the second image as was seen by the viewer for the first image. The viewer's eye can integrate these repeating luminance pulses of the repeating pattern to provide the stable image on the LCD display.

So, when adjacent pixels transition from providing to not providing luminance (or providing more luminance to less luminance in cases of gray states and the like), the overall repeating pattern of the luminance pulses does not change enough for the viewer to see a luminance flash or jump. Because, in many embodiments, the pixel turn on and turn off times are a function of the viewing angle of the observer, one benefit of such a consistent average luminance approach is that the viewer can view the screen from any suitable angle with the benefit of improved flashing characteristics. In some embodiments, a gray frame could be inserted for the off state 332 during the second half 338 of each refresh cycle 310.

Figure 4:
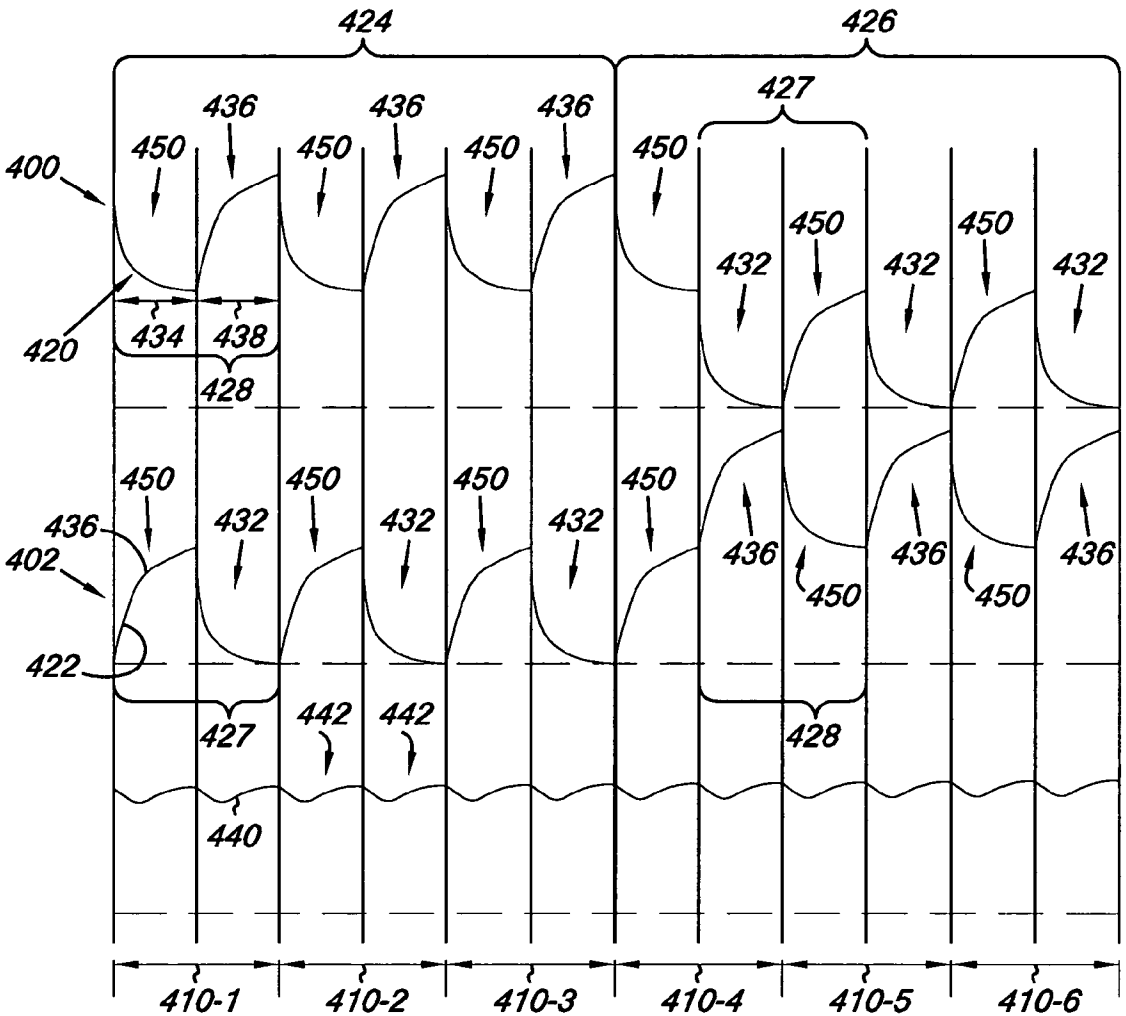
FIG. 4 is an illustration of pixels having a gray frame inserted between the on states and off states of the refresh cycle to produce an area of brightness having consistent luminance.

FIG. 4 provides an illustration of two adjacent pixels elements in which a gray frame 450 has been inserted into the state of the pixels to produce an area of brightness having consistent luminance for display images produced by the LCD device. In the example shown in FIG. 4, graphs of two pixels 400 and 402 (as viewed by a viewer) are presented along with a combined graph 440 showing the area of brightness with the transition of information (e.g, the change from a first image 424 to a second image 426 of the displayed images) between the first pixel 400 and the second pixel 402 as viewed by a viewer.

If the hardware refresh cycle of the display is faster than 120 Hz, then 434 and 438 as shown in FIG. 4 could be treated as a refresh cycle and a software algorithm to insert a black or gray image during each of the refresh cycles corresponding to the original second portion 438 can implemented in software where the images are being generated.

The embodiment of FIG. 4 illustrates the luminance changes for the same transitions of the first pixel 400 and the second pixel 402 as that of the embodiment of FIG. 2 when a gray state 450 is used for refresh cycle portion 434.

In the various embodiments, a level of the gray frame used in the present disclosure can include an average luminance corresponding to an average luminance of the LCD device.

Alternatively, the level of the gray frame used can be an average luminance of two or more adjacent pixel elements (e.g., the first pixel and the second pixel).

Figure 5:
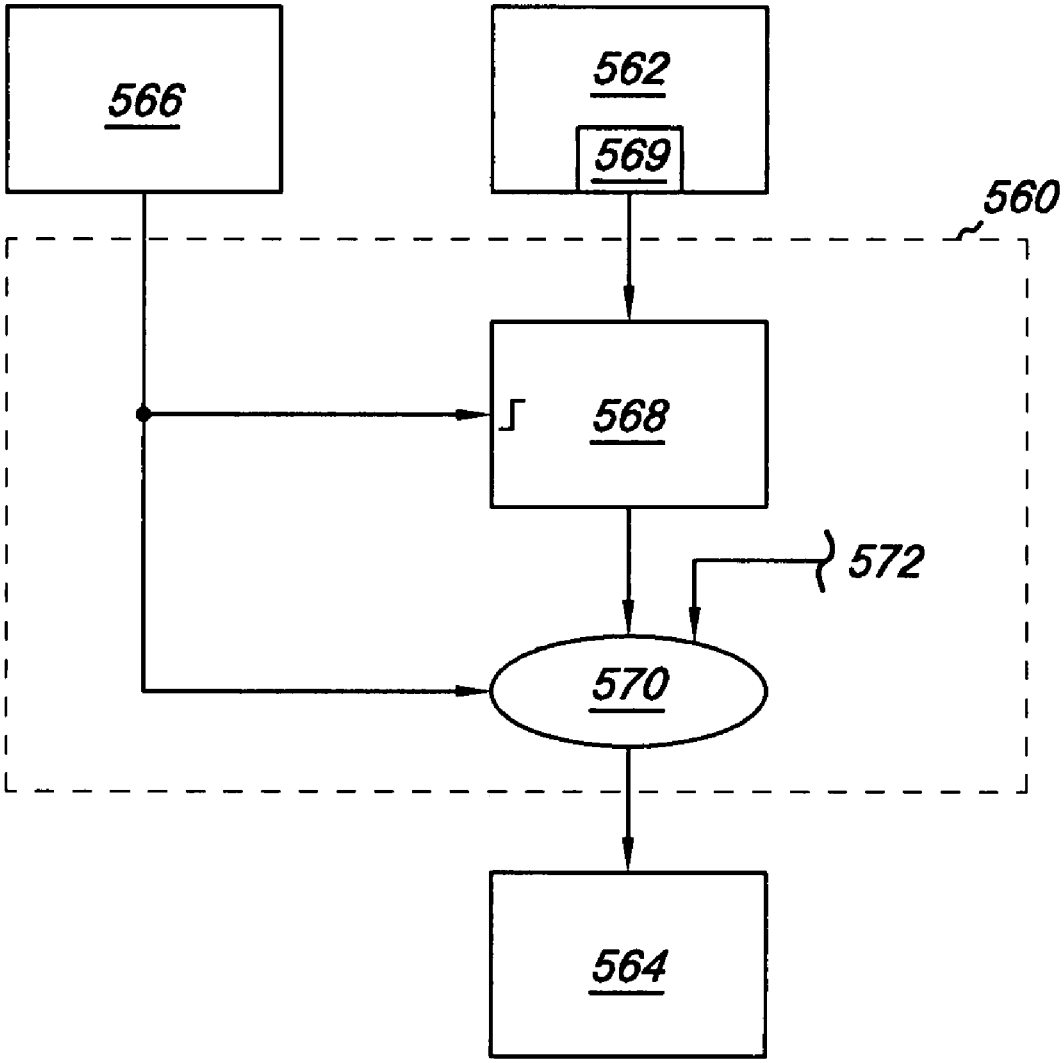
FIG. 5 is a block diagram of a display control device according to an embodiment of the present disclosure.

FIG. 5 provides an illustration of a block diagram of a display control device 560 according to an embodiment of the present disclosure. As illustrated, the display control device includes a main controller 562, or processor, that is in communication with the LCD panel 564 having a plurality of pixel elements. The display controller device 560 is also provided with a refresh cycle clock 566 in communication with the main controller 562 to provide a timing signal for the refresh cycle of the LCD panel 564.

Executable instructions can be used to generate display data, such as a sonar waterfall, to a display buffer memory 569. A data register 568 in communication with the main controller 562 and the refresh cycle clock 566 can receive input pixel values from the display buffer memory 569 through the main controller 562. A multiplexer 570 in communication with the data register 568 and the refresh cycle clock 566 can route an on state, an off state, gray frame 572 and/or black frame 572 for the pixel value to the LCD panel 564 during each of the refresh cycles, as discussed herein.

Embodiments of the present disclosure can be performed using executable instructions provided in a memory and executable by a processor to accomplish the functions described herein. The executable instructions to accomplish the functions described herein can be written in graphics programming library such as X windows, OpenGL, GGI, or DirectX, among other graphics programming libraries that support the creation of custom processing functions that can be downloaded and executed on a graphics processing unit (GPU). In such embodiments, the algorithm can transition, or cycle, the state of one or more pixels providing a first display image on the plurality of pixels of the LCD device during each of the refresh cycles of the first display image.

Although specific embodiments have been illustrated and described herein, those of ordinary skill in the art will appreciate that any arrangement calculated to achieve the same techniques can be substituted for the specific embodiments shown. This disclosure is intended to cover adaptations or variations of various embodiments of the present disclosure. It is to be understood that the above description has been made in an illustrative fashion, and not a restrictive one.

Combination of the above embodiments, and other embodiments not specifically described herein will be apparent to those of ordinary skill in the art upon reviewing the above description. The scope of the various embodiments of the present disclosure includes various other applications in which the above structures and methods are used. Therefore, the scope of various embodiments of the present disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the present disclosure require more features than are expressly recited in each claim.

Rather, as the following claims reflect, inventive subject matter may lie in less than all features of a single disclosed embodiment. Thus, the following claims are hereby incorporated into the Detailed Description, with each claim standing on its own as a separate embodiment.

What is claimed:

1. A method for providing image stability in a liquid crystal display (LCD) device, comprising:

providing a first display image to a plurality of pixel elements of the LCD at a first time, where the first display image includes a first pixel in an on state;

transitioning the on state of the first pixel to an off state, during a refresh cycle of the first display image;

transitioning the off state of the first pixel back to the on state during a next sequential refresh cycle of the first display image; and providing a second display image to the plurality of the pixel elements of the LCD at a second time subsequent to the first time, where the second display image includes a second pixel in an on state and the first pixel in the off state wherein the second pixel is adjacent to the first pixel;

transitioning the on state of the second pixel to an off state during the refresh cycle of the second display image;

transitioning the off state of the second pixel back to the on state during the next subsequent refresh cycle of the second display image;

transitioning the first display image to the second display occurs when both the first pixel and the second pixel are in or transitioning to the off state; and producing an area of brightness in the LCD with the first pixel and the second pixel that has a consistent repeating pattern of luminance for each refresh cycle such that the consistent repeating pattern of luminance for each refresh cycle produces a perception of consistent luminance for each refresh cycle.

2. The method of claim 1, where transitioning the first pixel to the off state during the refresh cycle of the first display image occurs during one of a first part and a second part of the refresh cycle.

3. The method of claim 1, where transitioning the first pixel from the on state to the off state occurs in a single refresh cycle.

4. The method of claim 1, where transitioning the on state of the first pixel and the second pixel to an off state includes inserting a black frame for the off state of the first pixel and the second pixel.

5. The method of claim 1, where transitioning the on state of the first pixel and the second pixel to an off state includes inserting a gray frame for the off state of the first pixel and the second pixel.

6. The method of claim 5, where the gray frame includes an average luminance corresponding to an average luminance of the LCD.

7. The method of claim 1, where the off state occurs at the beginning of the refresh cycle.

8. A method of producing a stable image in a liquid crystal display (LCD) device, comprising:

providing a first display image to pixel elements of the LCD;

cycling a first pixel element of the first display image between one of an on state and an off state for each refresh cycle of the first display image;

providing a second display image to the pixel elements of the LCD subsequent to providing the first display image; and cycling a second pixel element of the second display image between one of an on state and an off state for each refresh cycle of the second display image wherein providing the second display image occurs when the first pixel element and the second pixel element are in or transitioning to the off state to produce an area of brightness in the LCD with the first pixel and the second pixel that has a consistent repeating pattern of luminance for each refresh cycle such that the consistent repeating pattern of luminance for each refresh cycle produces a perception of consistent luminance for each refresh cycle, wherein the second pixel element is adjacent to the first pixel element.

9. The method of claim 8, where cycling at least one of the first and second pixel elements is between the on state and the off state during a single refresh cycle.

10. The method of claim 8, where cycling at least one of the first and second pixel elements is between the off state and the on state during a single refresh cycle.

11. The method of claim 8, including inserting a black frame as the off state for at least one of the first pixel and the second pixel.

12. The method of claim 8, including inserting a gray frame as the off state for at least one of the first pixel and the second pixel.

13. The method of claim 12, where the gray frame includes an average luminance of the first pixel and the second pixel.

14. The method of claim 8, where the luminance is an average luminance of the first and second pixel elements.

15. A method of producing a stable image in liquid crystal display (LCD) device, comprising:

providing a first display image to pixel elements of the LCD at a first time;

transitioning a preselected group of pixel elements of the first display image between a first state and a second state during each refresh cycle of the first display image;

providing a second display image to pixel elements of the LCD at a second time subsequent to the first time; and transitioning a preselected group of pixel elements of the second display image between a first state and a second state during each refresh cycle of the second display image, wherein transitioning to the second display occurs when both the preselected group of pixel elements are in or transitioning to the off state to produce an area of brightness in the LCD that has a consistent repeating pattern of luminance for each refresh cycle such that the consistent repeating pattern of luminance for each refresh cycle produces a perception of consistent luminance for each refresh cycle.

16. The method of claim 15, where transitioning the preselected group of pixel elements during each refresh cycle occurs about half way through the refresh cycle.

17. The method of claim 15, where the preselected group of pixel elements includes a random selection of at least fifty (50) percent of the pixel elements of the LCD.

18. The method of claim 15, where transitioning the preselected group of pixel elements during each refresh cycle includes inserting one of a black frame and a gray frame for at least one of the first state and the second state.

* * * * *